US006877553B2

(12) United States Patent
Cameron

(10) Patent No.: US 6,877,553 B2
(45) Date of Patent: Apr. 12, 2005

(54) PROFILED RECESS FOR INSTRUMENTED EXPANDABLE COMPONENTS

(75) Inventor: John A. M. Cameron, Kemnay (GB)

(73) Assignee: Weatherford/Lamb, Inc., Houston, TX (US)

( * ) Notice: Subject to any disclaimer, the term of this patent is extended or adjusted under 35 U.S.C. 154(b) by 113 days.

(21) Appl. No.: 09/964,034

(22) Filed: Sep. 26, 2001

(65) Prior Publication Data

US 2003/0056947 A1 Mar. 27, 2003

(51) Int. Cl.[7] ..... E21B 43/10; E21B 43/08
(52) U.S. Cl. ..... 166/207; 166/242.1; 166/65.1
(58) Field of Search ..... 166/65.1, 66, 206, 166/207, 242.1, 242.2

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 1,981,525 | A | 11/1934 | Price | 166/4 |
| 2,214,226 | A | 9/1940 | English | 166/1 |
| 2,383,214 | A | 8/1945 | Prout | 153/82 |
| 2,499,630 | A | 3/1950 | Clark | 153/81 |
| 2,627,891 | A | 2/1953 | Clark | 153/82 |
| 2,663,073 | A | 12/1953 | Bieber et al. | 29/148 |
| 2,898,971 | A | 8/1959 | Hempel | 153/82 |
| 3,087,546 | A | 4/1963 | Wooley | 166/46 |

(Continued)

FOREIGN PATENT DOCUMENTS

| | | | |
|---|---|---|---|
| EP | 0 651 130 A2 | 5/1995 | E21B/33/127 |
| EP | 0 961 007 | 12/1999 | E21B/33/10 |
| GB | 2 216 926 | 10/1989 | E21B/7/20 |
| GB | 2 320 734 | 7/1998 | E21B/33/127 |
| GB | 2 329 918 | 4/1999 | E21B/43/10 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/75933 | 12/2000 | H01B/7/04 |
| WO | WO 01/29368 A1 | 4/2001 | E21B/34/14 |
| WO | WO 02/055841 A2 | 7/2002 | E21B/43/00 |

OTHER PUBLICATIONS

U.S. Appl. No. 09/990,092, filed Nov. 21, 2001, Simpson et al.
U.S. Appl. No. 09/964,160, filed Sep. 26, 2001, Cameron.

(Continued)

*Primary Examiner*—David Bagnell
*Assistant Examiner*—B. D. Halford
(74) *Attorney, Agent, or Firm*—Moser, Patterson & Sheridan, L.L.P.

(57) ABSTRACT

The present invention provides a recess within an expandable downhole tubular, such as an expandable sand screen. The recess resides within the wall, such as the outer shroud of an expandable sand screen. The recess serves as a housing for instrumentation lines, fiber optics, control lines, or downhole instrumentation. By placing the lines and instrumentation within a wall of the expandable downhole tool, the tool can be expanded into the wall of the wellbore without leaving a channel outside of the tool through which formation fluids might vertically migrate. The recess is useful in both cased hole and open hole completions. In one embodiment, the recess serves as a housing for an encapsulation which itself may house instrumentation lines, control lines, and downhole instrumentation.

41 Claims, 4 Drawing Sheets

U.S. PATENT DOCUMENTS

| | | | | | |
|---|---|---|---|---|---|
| 3,191,677 | A | | 6/1965 | Kinley | 166/14 |
| 3,195,646 | A | | 7/1965 | Brown | 166/208 |
| 3,467,180 | A | | 9/1969 | Pensotti | 165/180 |
| 3,712,376 | A | | 1/1973 | Owen et al. | 166/277 |
| 3,776,307 | A | | 12/1973 | Young | 166/125 |
| 3,818,734 | A | | 6/1974 | Bateman | 72/75 |
| 3,844,345 | A | * | 10/1974 | Evans et al. | 166/242.3 |
| 3,911,707 | A | | 10/1975 | Minakov et al. | 72/76 |
| 3,948,321 | A | | 4/1976 | Owen et al. | 166/277 |
| 4,069,573 | A | | 1/1978 | Rogers, Jr. et al. | 29/421 R |
| 4,127,168 | A | | 11/1978 | Hanson et al. | 166/123 |
| 4,159,564 | A | | 7/1979 | Cooper, Jr. | 29/727 |
| 4,288,082 | A | | 9/1981 | Setterberg, Jr. | 277/125 |
| 4,319,393 | A | | 3/1982 | Pogonowski | 29/434 |
| 4,324,407 | A | | 4/1982 | Upham et al. | 277/27 |
| 4,429,620 | A | | 2/1984 | Burkhardt et al. | 91/395 |
| 4,444,403 | A | | 4/1984 | Morris | |
| 4,531,581 | A | | 7/1985 | Pringle et al. | 166/120 |
| 4,569,392 | A | | 2/1986 | Peterman | 166/242 |
| 4,588,030 | A | | 5/1986 | Blizzard | 166/120 |
| 4,697,640 | A | | 10/1987 | Szarka | 166/120 |
| 4,848,469 | A | | 7/1989 | Baugh et al. | 166/382 |
| 5,052,483 | A | | 10/1991 | Hudson | 166/55 |
| 5,161,613 | A | | 11/1992 | Jones | |
| 5,271,472 | A | | 12/1993 | Leturno | 175/107 |
| 5,409,059 | A | | 4/1995 | McHardy | 166/208 |
| 5,435,400 | A | | 7/1995 | Smith | 175/61 |
| 5,472,057 | A | | 12/1995 | Winfree | 175/57 |
| 5,542,472 | A | * | 8/1996 | Pringle et al. | 166/65.1 |
| 5,560,426 | A | | 10/1996 | Trahan et al. | 166/120 |
| 5,685,369 | A | | 11/1997 | Ellis et al. | 166/195 |
| 5,901,787 | A | | 5/1999 | Boyle | 166/135 |
| 5,901,789 | A | | 5/1999 | Donelly et al. | 166/381 |
| 6,021,850 | A | | 2/2000 | Wood et al. | 166/380 |
| 6,029,748 | A | | 2/2000 | Forsyth et al. | 166/380 |
| 6,098,717 | A | | 8/2000 | Bailey et al. | 166/382 |
| 6,173,788 | B1 | | 1/2001 | Lembcke et al. | 166/387 |
| 6,196,766 | B1 | | 3/2001 | Graham | 405/184 |
| 6,237,687 | B1 | | 5/2001 | Barbee, Jr. et al. | |
| 6,446,723 | B1 | * | 9/2002 | Ramos et al. | 166/65.1 |
| 6,457,518 | B1 | * | 10/2002 | Castano-Mears et al. | 166/207 |
| 6,585,053 | B2 | | 7/2003 | Coon | |
| 6,591,905 | B2 | | 7/2003 | Coon | |
| 6,752,216 | B2 | | 6/2004 | Coon | |
| 6,766,857 | B2 | | 7/2004 | Bixenman et al. | |
| 2001/0030076 | A1 | | 10/2001 | Paulsson | |
| 2001/0047871 | A1 | | 12/2001 | Johnson et al. | |
| 2002/0053439 | A1 | | 5/2002 | Danos | 166/380 |
| 2002/0088744 | A1 | * | 7/2002 | Echols et al. | 210/170 |
| 2002/0092649 | A1 | | 7/2002 | Bixenman et al. | 166/278 |
| 2002/0125009 | A1 | | 9/2002 | Wetzel et al | |
| 2003/0042022 | A1 | | 3/2003 | Lauritzen et al. | |

OTHER PUBLICATIONS

U.S. Appl. No. 09/904,735, filed Jul. 13, 2001, Badrak et al.
U.S. Appl. No. 09/885,850, filed Jun. 20, 2001, Lauritzen et al.
U.S. Appl. No. 09/849,624, filed May 04, 2001, Bode et al.
U.S. Appl. No. 09/848,900, filed May 04, 2001, Haugen et al.
U.S. Appl. No. 09/818,119, filed Mar. 27, 2001, Lauritzen.
U.S. Appl. No. 09/470,176, filed Dec. 22, 1999, Metcalfe et al.
U.S. Appl. No. 09/470,154, filed Dec 22, 1999, Metcalfe et al.
U.S. Appl. No. 09/469,692, filed Dec. 22, 1999, Trahan.
U.S. Appl. No. 09/469,690, filed Dec. 22, 1999, Simpson.
U.S. Appl. No. 09/469,681, filed Dec. 22, 1999, Metcalfe et al.
U.S. Appl. No. 09/469,643, filed Dec. 22, 1999, Metcalfe et al.
U.S. Appl. No. 09/469,526, filed Dec. 22, 1999, Metcalfe et al.
PCT International Preliminary Examination Report, International Application No. PCT/GB02/04315, dated May 28, 2003.
PCT International Search Report, International Application No. PCT/GB02/04315, dated Jan. 2, 2003.
PCT Written Opinion, International Application No. PCT/GB/02/04303 dated May 28, 2003.
PCT International Search Report, International Application No. PCT/GB02/04303, dated Nov. 21, 2002.

* cited by examiner

PROFILED RECESS FOR INSTRUMENTED EXPANDABLE COMPONENTS

BACKGROUND OF THE INVENTION

1. Field of the Invention

The present invention relates to well completions using expandable components. More particularly, the present invention relates to a profiled recess incorporated into an expandable sand screen or other expandable downhole tubular. The profiled recess houses instrumentation lines or control lines in a wellbore.

2. Description of Related Art

Hydrocarbon wells are typically formed with a central wellbore that is supported by steel casing. The steel casing lines the borehole formed in the earth during the drilling process. This creates an annular area between the casing and the borehole, which is filled with cement to further support and form the wellbore.

Some wells are produced by perforating the casing of the wellbore at selected depths where hydrocarbons are found. Hydrocarbons migrate from the formation, through the perforations, and into the cased wellbore. In some instances, a lower portion of a wellbore is left open, that is, it is not lined with casing. This is known as an open hole completion. In that instance, hydrocarbons in an adjacent formation migrate directly into the wellbore where they are subsequently raised to the surface, typically through an artificial lift system.

Open hole completions carry the potential of higher production than a cased hole completion. They are frequently utilized in connection with horizontally drilled boreholes. However, open hole completions present various risks concerning the integrity of the open wellbore. In that respect, an open hole leaves aggregate material, including sand, free to invade the wellbore. Sand production can result in premature failure of artificial lift and other downhole and surface equipment. Sand can build up in the casing and tubing to obstruct well flow. Particles can compact and erode surrounding formations to cause liner and casing failures. In addition, produced sand becomes difficult to handle and dispose at the surface. Ultimately, open holes carry the risk of complete collapse of the formation into the wellbore.

To control particle flow from unconsolidated formations, for example, well screens are often employed downhole along the uncased portion of the wellbore. One form of well screen recently developed is the expandable sand screen, known as Weatherford's ESS® tool. In general, the ESS® is constructed from three composite layers, including an intermediate filter media. The filter media allows hydrocarbons to invade the wellbore, but filters sand and other unwanted particles from entering. The sand screen is attached to production tubing at an upper end and the hydrocarbons travel to the surface of the well via the tubing. In one recent innovation, the sand screen is expanded downhole against the adjacent formation in order to preserve the integrity of the formation during production.

A more particular description of an expandable sand screen is described in U.S. Pat. No. 5,901,789, which is incorporated by reference herein in its entirety. That patent describes an expandable sand screen which consists of a perforated base pipe, a woven filtering material, and a protective, perforated outer shroud. Both the base pipe and the outer shroud are expandable, and the woven filter is typically arranged over the base pipe in sheets that partially cover one another and slide across one another as the sand screen is expanded. The sand screen is expanded by a cone-shaped object urged along its inner bore or by an expander tool having radially outward extending rollers that are fluid powered from a tubular string. Using expander means like these, the sand screen is subjected to outwardly radial forces that urge the walls of the sand screen against the open formation. The sand screen components are stretched past their elastic limit, thereby increasing the inner and outer diameter of the sand screen.

The biggest advantage to the use of an expandable sand screen in an open wellbore like the one described herein is that once expanded, the annular area between the screen and the wellbore is mostly eliminated, and with it the need for a gravel pack. Typically, the ESS® is expanded to a point where its outer wall places a stress on the wall of the wellbore, thereby providing support to the walls of the wellbore to prevent dislocation of particles.

In modern well completions, the operator oftentimes wishes to employ downhole tools or instruments. These include sliding sleeves, submersible electrical pumps, downhole chokes, and various sensing devices. These devices are controlled from the surface via hydraulic control lines, mechanical control lines, or even fiber optic cable. For example, the operator may wish to place a series of pressure and/or temperature sensors every ten meters within a portion of the hole, connected by a fiber optic line. This line would extend into that portion of the wellbore where an expandable tubular has been placed.

In order to protect the control lines or instrumentation lines, the lines are typically placed into small metal tubings which are affixed external to the completion tubular and the production tubing within the wellbore. In addition, in completions utilizing known non-expandable gravel packs, the control lines have been housed within a rectangular box. However, this method of housing control lines or instrumentation downhole is not feasible in the context of the new, expandable sand screens now being offered.

First, the presence of control lines behind an expandable completion tubular or tool interferes with an important function of the expandable tubular, which is to provide a close fit between the outside surface of the tubular and the formation wall (or surrounding casing). This is particularly true with the rectangular boxes normally used. The absence of a close fit between the outside surface of the expandable tubular and the formation wall creates a vertical channel outside of the sand screen, allowing formation fluids to migrate between formations therein, even to the surface. This, in turn, causes inaccurate pressure, temperature, or other readings from downhole instrumentation, particularly when the well is shut in for a period of time.

There is a need, therefore, for a protective encapsulation for control lines or instrumentation lines which does not hinder the expansion of the expandable tool closely against the formation wall (or casing). There is further a need for an encapsulation which does not leave a vertical channel outside of the expandable tubular when it is expanded against the formation wall (or casing). Still further, there is a need for an encapsulation device which defines a recess in the wall of an expandable sand screen or other expandable downhole tool, and which provides enhanced protection to the control lines/fiber optics as it is expanded against the wall of a wellbore, whether cased or open.

SUMMARY OF THE INVENTION

The present invention provides a recess for housing instrumentation lines, control lines, or fiber optics downhole. In one aspect, the encapsulation defines a recess in the wall of an expandable tubular such as an expandable sand screen. Because the encapsulation resides within the wall of the downhole tool, no vertical channeling of fluids within the annulus outside of the tool, e.g., sand screen, occurs. The recess of the present invention may be employed whether the completion is cased or open.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
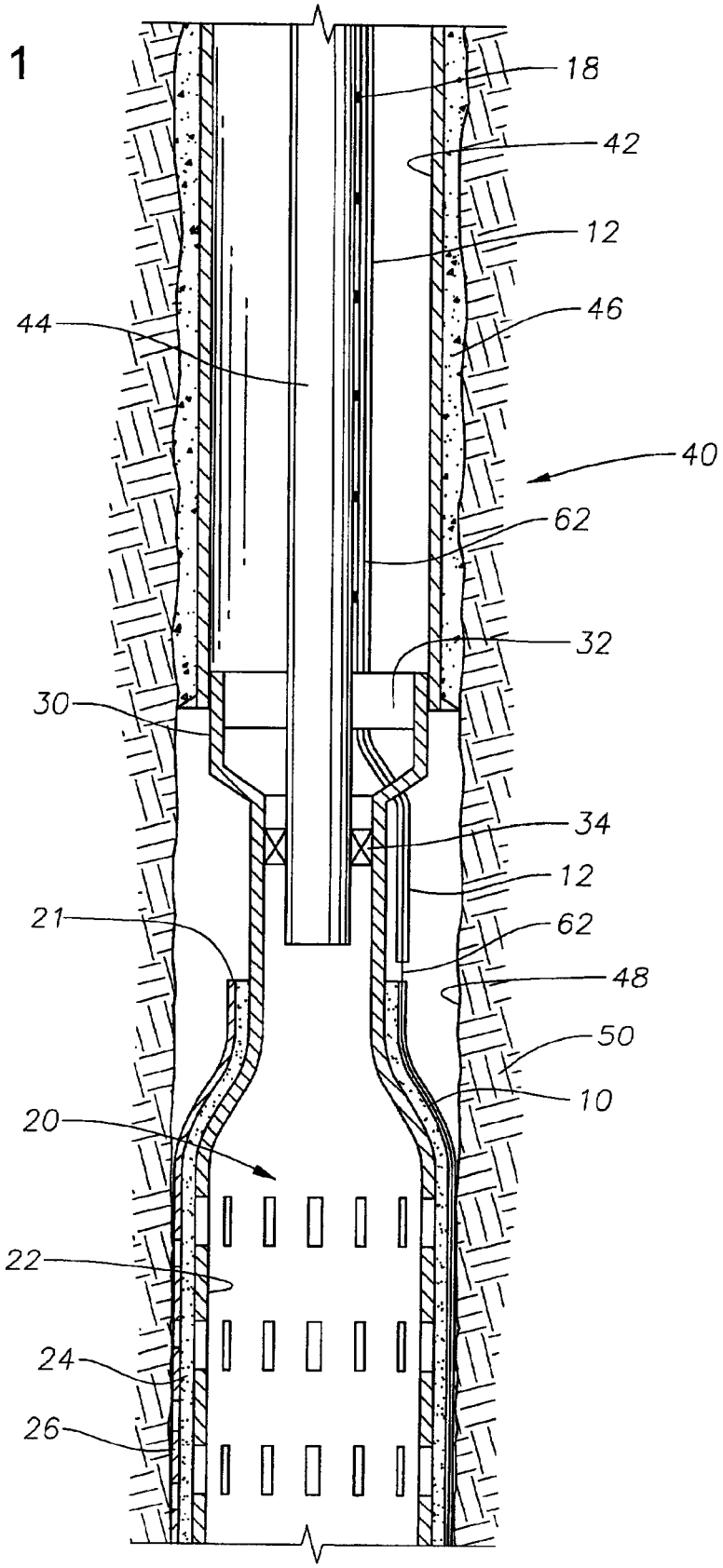
FIG. 1 is a section view showing an open hole wellbore with an expandable sand screen disposed therein. A recess of the present invention is shown in cross-section within the wall of the expandable sand screen as an example of an expandable tubular. A traditional rectangular box is shown, in cross-section, running from the surface to the depth of the sand screen.

FIG. 1 is a section view showing an open hole wellbore 40. The wellbore 40 includes a central wellbore which is lined with casing 42. The annular area between the casing 42 and the earth is filled with cement 46 as is typical in well completion. Extending downward from the central wellbore is an open hole wellbore 48. A formation 50 is shown adjacent to the wellbore 48.

Disposed in the open wellbore 48 is an expandable sand screen 20. The expandable sand screen 20 is hung within the wellbore 40 from a hanging apparatus 32. In some instances, the hanging apparatus 32 is a packer (not shown). In the depiction of FIG. 1, the hanging apparatus is a liner 30 and liner hanger 32. A separate packer 34 is employed to seal the annulus between the liner 30 and the production tubular 44.

Also depicted in FIG. 1 is an upper hole encapsulation 12. The upper hole encapsulation 12 shown is a cross-section of a standard rectangular-shaped box typically employed when running instrumentation lines or cable lines downhole. However, a specially profiled encapsulation may be used which contains arcuate walls, as disclosed in the pending application entitled "Profiled Encapsulation for Use With Expandable Sand Screen," having U.S. patent application Ser. No. 09/964,160.

The upper hole encapsulation 12 is shown running from the surface to the depth of the sand screen 20. The encapsulation 12 is secured to the production tubular 44 by clamps, shown schematically at 18. Clamps 18 are typically secured to the production tubular 44 approximately every ten meters. The upper hole encapsulation 12 passes through the liner hanger 32 (or utilized hanging apparatus), and extends downward to a designated depth within the wellbore 40. In the embodiment shown in FIG. 1, the encapsulation 12 extends to the top 21 of the sand screen 20.

At or near the depth of the hanging apparatus 32, the upper hole encapsulation 12 terminates. However, the instrumentation lines or cable lines 62 continue from the upper hole encapsulation 12 and to a desired depth. In FIG. 1, the lines 62 travel to the bottom 25 of the sand screen 20 and the open hole wellbore 48.

In accordance with the present invention, the lines 62 reside within a novel recess 10 within the wall of an expandable tubular 20. The exemplary expandable tubular 20 depicted in FIG. 1 is an expandable sand screen. The recess 10 is visible in FIG. 1 along the outside wall 26 of the sand screen 20. The recess 10 serves as a housing for instrumentation lines or control lines 62. For purposes of this application, such lines 62 include any type of data acquisition lines, communication lines, fiber optics, cables, sensors, and downhole "smart well" features.

Figure 2:
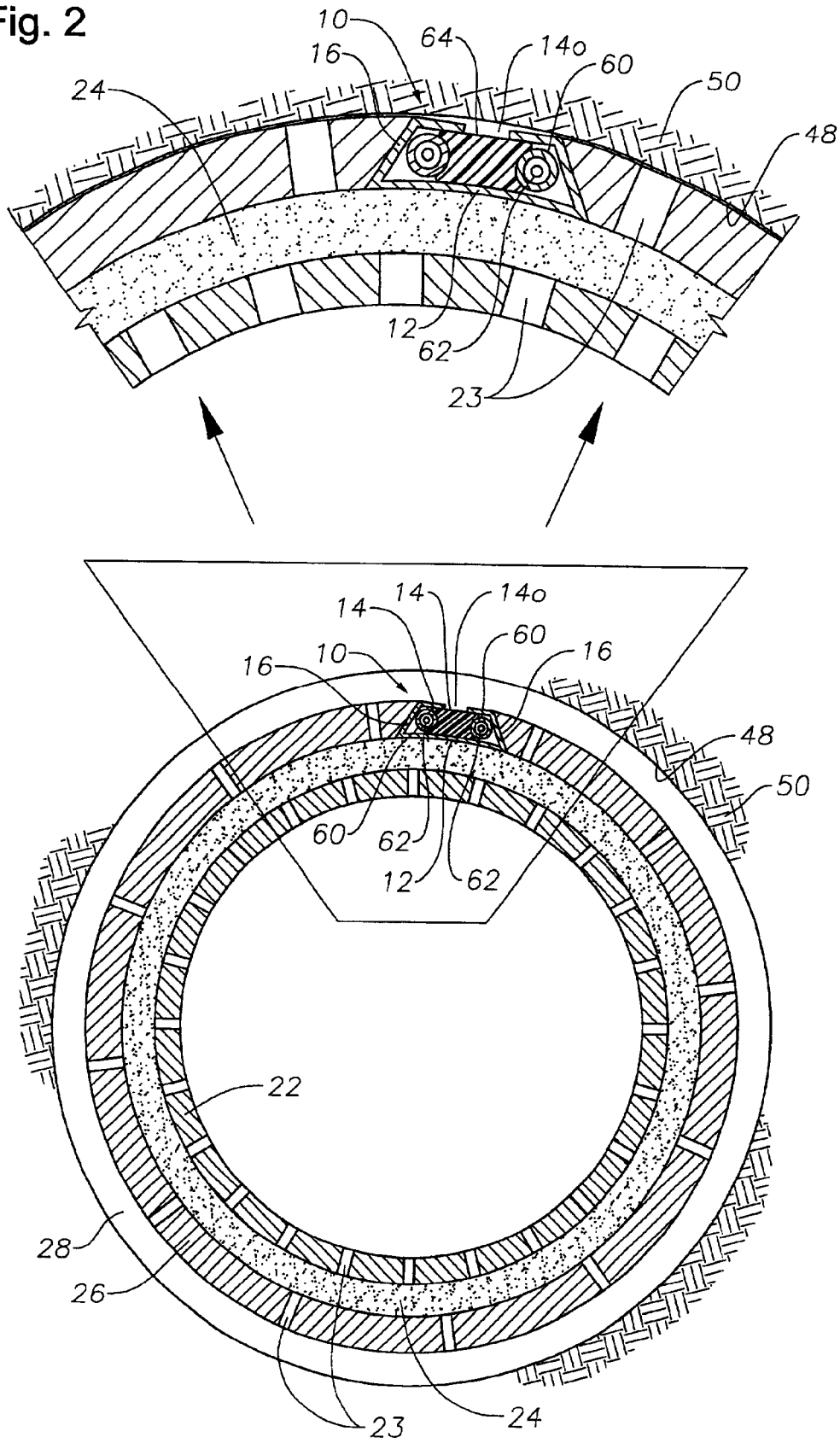
FIG. 2 is a top section view of an expandable sand screen within an open wellbore. Visible is a profiled recess of the present invention residing in the outer layer of the sand screen wall. The sand screen is in its unexpanded state with an enlarged view showing a portion of the sand screen expanded against the formation.

FIG. 2 presents a top section view of a recess 10 of the present invention. In this view, the recess 10 is shown to reside within the outer layer 26 of an expandable tubular 20. An enlarged section of the tubular 20 is shown expanded against the formation. Again, the depicted expandable tubular 20 is an expandable sand screen. However, it is within the scope of this invention to utilize a profiled recess 10 in any expandable tubular or tool.

In the embodiment of FIG. 2, the sand screen 20 is constructed from three composite layers. These define a slotted structural base pipe 22, a layer of filter media 24, and an outer protecting sheath, or "shroud" 26. Both the base pipe 22 and the outer shroud 26 are configured to permit hydrocarbons to flow therethrough, such as through perforations (e.g., 23) formed therein. The filter material 24 is held between the base pipe 22 and the outer shroud 26, and serves to filter sand and other particulates from entering the sand screen 20 and the production tubular 44. Again, it is within the scope of this invention to utilize a profiled recess 10 in an expandable tool having any configuration of layers.

In the embodiment shown in FIG. 2, the recess 10 is specially profiled to conform to the arcuate profile of the expandable tubular 20. To accomplish this, the recess 10 includes at least one arcuate wall 12. In the embodiment of FIG. 2, the recess 10 defines an inner arcuate wall 12, an outer arcuate wall 14, and two end walls 16. In this embodiment, the outer arcuate wall 14 includes an optional through-opening 14*o* to aid in the insertion of lines 62. In addition, the control or instrumentation lines 62 are housed within optional metal tubulars 60. Finally, the embodiment in FIG. 2 includes an optional filler material 64 in order to maintain the one or more lines 62 within the recess 10. The filler material 64 may be an extrudable polymeric material such as polyethylene, a hardenable foam material such as polyethylene, or other suitable material for holding the lines 62 within the recess 10.

Figure 3:
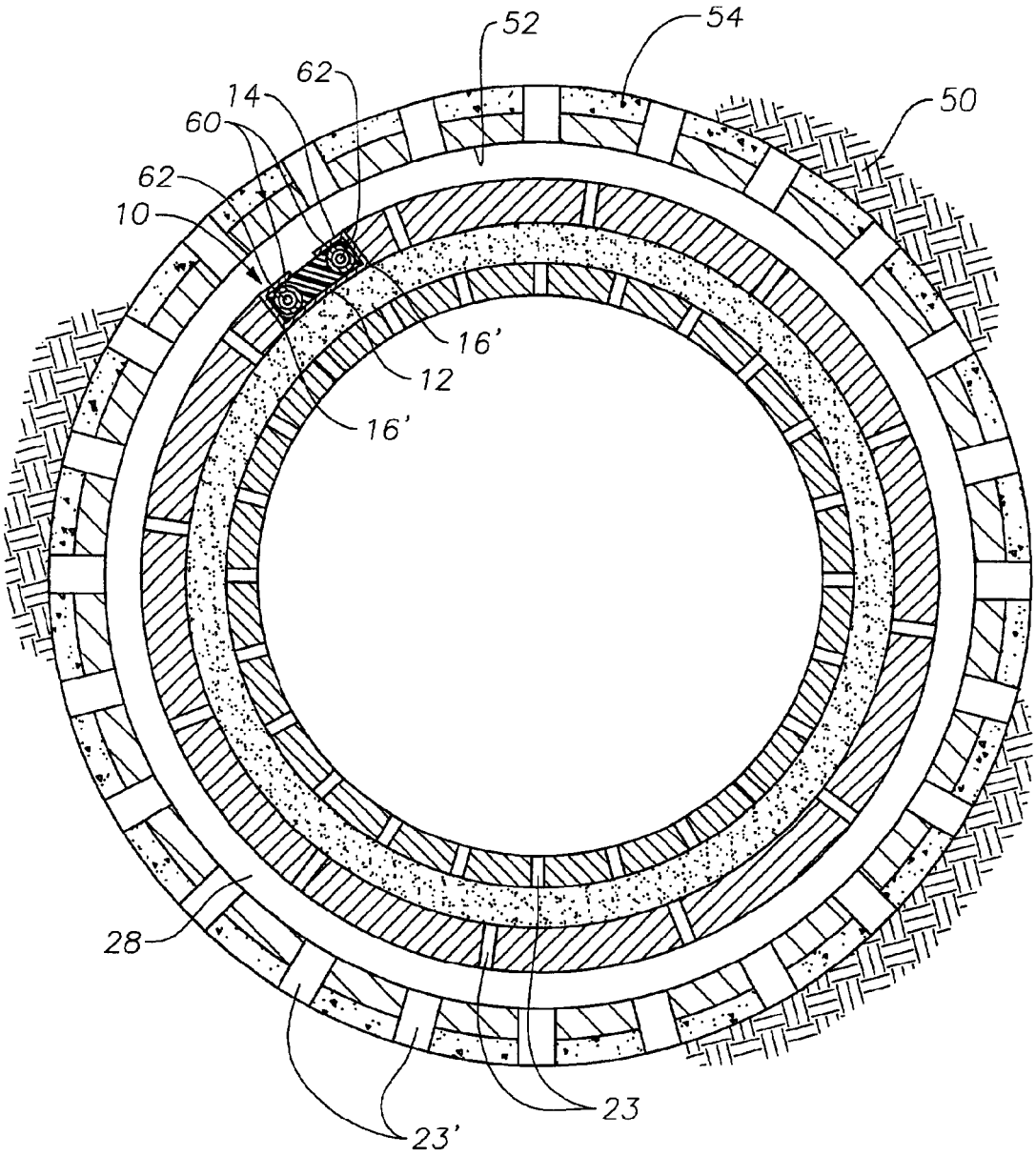
FIG. 3 is also a top section view of an expandable sand screen within an open wellbore, with the recess in an alternate configuration. The sand screen is disposed within a cased wellbore in its unexpanded state.

Numerous alternate embodiments exist for the configuration of the recess 10 of the present invention. One exemplary alternate configuration for a recess 10 is shown in FIG. 3. There, the recess 10 comprises a first inner arcuate wall 12 and a second outer arcuate wall 14. The two arcuate walls 12 and 14 meet at opposite ends 16'. However, it is within the scope of this invention to provide any shaped recess 10 formed essentially within any layer of the wall 26 of an expandable downhole tubular 20. When the recess 10 of FIG. 2 or 3 or equivalent embodiments are employed, no vertical channel is left within the annular region 28 between the sand screen and the formation 50 after the sand screen 20 is expanded.

Figure 4:
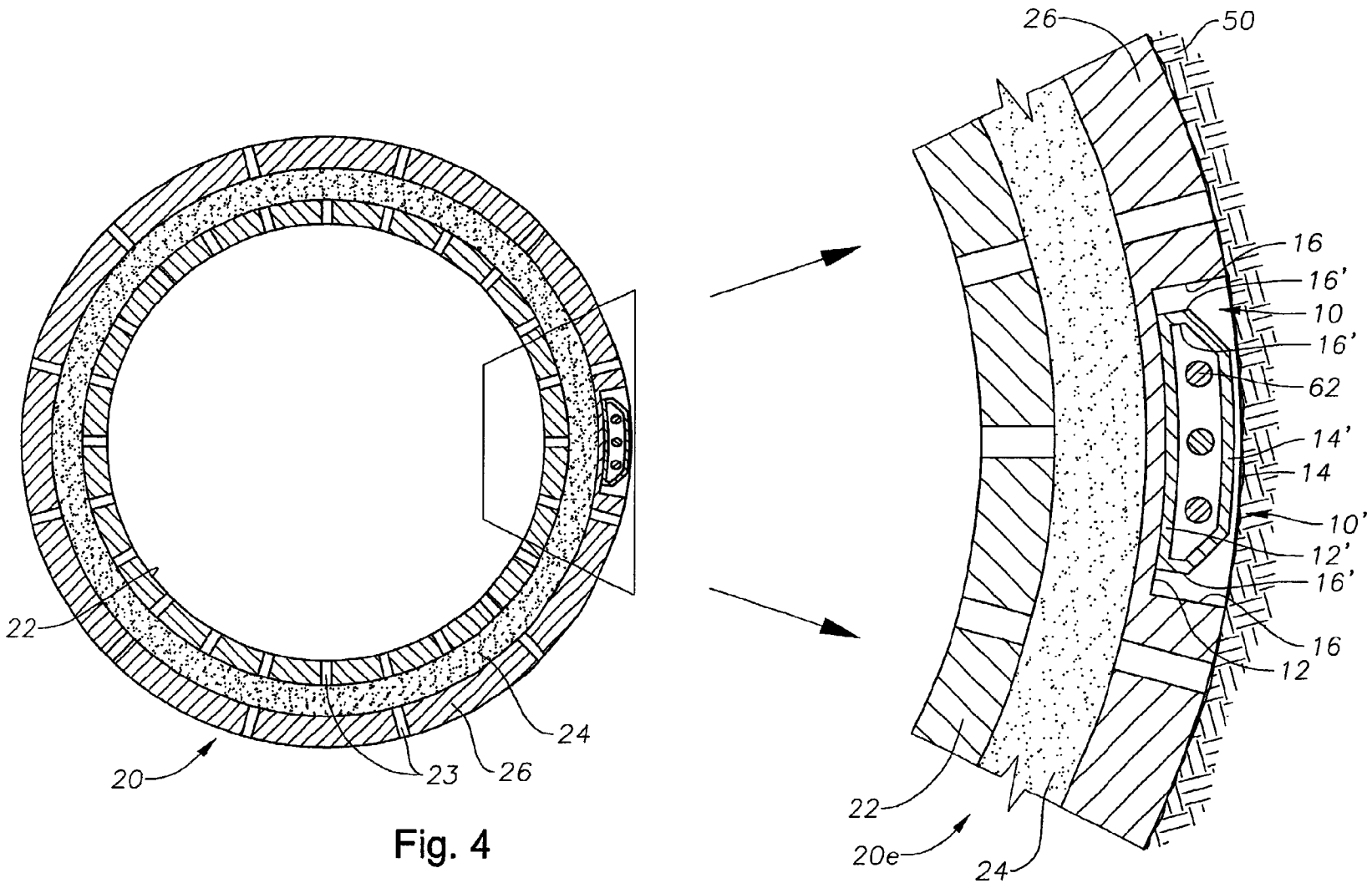
FIG. 4 is a top section view of an expandable sand screen before expansion, and a blow-up view of a portion of the expandable sand screen as expanded against a wellbore formation. An alternate embodiment of an encapsulation is demonstrated within the recess.

In another embodiment of the present invention, a separate profiled encapsulation 10' is provided within the recess 10 of the expandable tubular 20. Such an encapsulation 10' is shown in FIG. 4 where the expandable tubular 20 is again, by way of example only, an expandable sand screen. FIG. 4 presents a portion 20*e* of an expandable sand screen 20 in an expanded state. This demonstrates that the sand screen 20 remains sand tight after expansion. (Note that the expanded depiction is not to scale.) Radial force applied to the inner wall of the perforated base pipe 22 forces the pipe 22 past its elastic limits and also expands the diameter of the base pipe perforations 23. Also expanded is the shroud 26. As shown in FIG. 4, the shroud 26 is expanded to a point of contact with the formation 50. Substantial contact between the sand screen 20 and the formation wall 48 places a slight stress on the formation 50, reducing the risk of particulate matter entering the wellbore 48. It also reduces the risk of vertical fluid flow behind the sand screen 20.

The encapsulation 10' is shown in FIG. 4 to expand and deform with the recess 10. The encapsulation 10' is generally shaped to conform to the walls 12, 14, 16 of the recess 10. In this manner, the encapsulation 10 defines at least a first arcuate wall 12'. In the embodiment of FIG. 4, the encapsulation 10' includes an inner arcuate wall 12', an outer arcuate wall 14', and two end walls 16'. The encapsulation 10' serves as the housing for the instrumentation lines or cable lines 62. The encapsulation 10' may be inserted into the recess 10 either as part of the manufacturing process, or at the well site during downhole tool run-in. The encapsulation 10' is fabricated from a thermoplastic material which is durable enough to withstand abrasions while being pushed or press-fit into the recess 10. At the same time, the encapsulation 10' material must be sufficiently deformable to allow the encapsulation 10' to generally comply with the expandable tubular 20 as it is expanded against the formation 50.

Other embodiments for an encapsulation 10' exist. For example, a crescent-shaped encapsulation (not shown), designed to reside within the profiled recess 10 of FIG. 3 could be employed. In each of the above embodiments, the recess 10 may optionally also house metal tubulars 60 for holding the control or instrumentation lines 62. Metal tubulars 60 are demonstrated in the embodiments of FIGS. 2 and 3.

The sand screens 20 depicted in FIGS. 1–4 are designed to expand. Expansion is typically done by a cone or compliant expander apparatus or other expander tool (not shown) to provide a close fit between the expandable tubular 20 and the formation 50. In FIG. 1, the sand screen 20 has already been expanded against an open hole formation 50 so that no annular region remains. The sand screen 20 is thus in position for the production of hydrocarbons. The absence of an annular region substantially prohibits vertical movement of fluid behind the sand screen 20.

On the other hand, the expandable tubular 20 in FIG. 2 is in its unexpanded state. An annular region 28 is thus shown in FIG. 2 between the sand screen 20 and the formation 50 within the wellbore 48. In FIG. 3, the sand screen 20 is again in an unexpanded state. However, in this embodiment recess 10 is disposed within an expandable tubular 20 within a cased wellbore. Casing 52 is shown circumferential to the sand screen 20, creating an annulus 28. Further, cement 54 is present around the casing 52. Perforations 23' are fired into the casing 52 in order to expose hydrocarbons or other formation fluids to the wellbore 48. Thus, the recess 10 of the present invention has utility for both open hole and cased hole completions.

While the foregoing is directed to embodiments of the present invention, other and further embodiments of the invention may be devised without departing from the basic scope thereof, and the scope thereof is determined by the claims that follow.

What is claimed is:

1. An expandable sand screen, comprising:

a base pipe layer;

a filtering media layer around the base pipe layer; and an outer shroud around the filtering media layer, a wall of the outer shroud having a recess formed therein, the recess defining a housing for one or more of the following during expansion of the expandable sand screen: control lines, instrumentation lines, fiber optics, and downhole sensors, wherein the recess moves outward radially upon expansion of the expandable sand screen.

2. The expandable sand screen of claim 1, wherein the expandable sand screen is in an expanded state and the wall is in substantial contact with a wall of a wellbore.

3. The expandable sand screen of claim 2, wherein the recess comprises:

a first wall having a first end and a second end; and a second wall having a first end and a second end, the first and second ends of the first and second walls being connected so as to define a housing between the first and second walls; wherein at least one of the first and second walls is arcuate.

4. The expandable sand screen of claim 3, wherein the first and second walls are connected at first and second opposite points.

5. The expandable sand screen of claim 3, wherein the first and second walls are connected by first and second opposite end walls.

6. The expandable sand screen of claim 3, wherein the first and second walls are both arcuate.

7. The expandable sand screen of claim 1, wherein the expandable sand screen is in an expanded state and the wall is in substantial contact with casing disposed in a wellbore.

8. The expandable sand screen of claim 1, further comprising an encapsulation within the recess, the recess serving as a housing for one or more of the following: control lines, instrumentation lines, fiber optics, and downhole sensors, which reside within the encapsulation.

9. The expandable sand screen of claim 8, the encapsulation further comprises at least one arcuate wall.

10. The expandable sand screen of claim 8, the encapsulation further comprising:

a first arcuate wall having a first end and a second end; and a second wall having a first end and a second end, the first and second ends of the first and second walls of the encapsulation being connected so as to define a housing between the first and second walls of the encapsulation.

11. The expandable sand screen of claim 8, wherein the encapsulation is fabricated from a deformable material.

12. The expandable sand screen of claim 8, wherein the encapsulation further serves as a housing for at least one metal tubular, the at least one metal tubular housing the one or more of the following: control lines, instrumentation lines, and downhole sensors.

13. The expandable sand screen of claim 8, wherein the encapsulation defines a crescent shape.

14. The expandable sand screen of claim 8, further comprising a filler material to aid in holding the one or more of the following: control lines, instrumentation lines, fiber optics, and downhole sensors, within the encapsulation.

15. The expandable sand screen of claim 1, wherein the recess comprises at least one arcuate wall.

16. The expandable sand screen of claim 1, wherein the wall comprises a first thickness and the recess is formed within the first thickness.

17. The expandable sand screen of claim 1, wherein the recess defines a housing for two or more of the following during expansion of the expandable tubular: control lines, instrumentation lines, fiber optics, and downhole sensors.

18. The expandable sand screen of claim 1, wherein the recess is entirely disposed within the wall.

19. The expandable sand screen of claim 1, wherein the wall comprises an outer surface and an inner surface with a thickness therebetween, and wherein the recess is entirely disposed within the thickness.

20. The expandable sand screen of claim 1, further comprising a filler material to aid in holding the one or more of the following: control lines, instrumentation lines, fiber optics, and downhole sensors, within the recess.

21. The expandable sand screen of claim 1, wherein the expandable sand screen is usable in a wellbore within a formation and the wellbore includes an open hole portion such that the sand screen is expanded into substantial contact with the formation.

22. The expandable sand screen of claim 1, wherein the expandable sand screen is usable in a wellbore within a formation and the wellbore defines a cased hole completion such that the sand screen is expanded into substantial contact with the casing.

23. An apparatus for use in well completion operations, comprising:

an expandable sand screen comprising:

a base pipe layer, a filtering media layer around the base pipe layer, and an outer shroud around the filtering media layer; and one or more of the following located within a wall of the outer shroud: control fines, instrumentation lines, fiber optics, and downhole sensors, wherein the one or more of the following located within the wall of the outer shroud is protected during the expansion process when an inner wall of the expandable sand screen increases in diameter.

24. The apparatus of claim 23, wherein the one or more of control lines, instrumentation lines, fiber optics, and downhole sensors are housed within a recess in the wall of the outer shroud, wherein the recess protects the one or more of control lines, instrumentation lines, fiber optics, and downhole sensors during expansion of the expandable sand screen.

25. The apparatus of claim 24, further comprising an encapsulation disposed within the recess.

26. The apparatus of claim 25, wherein the encapsulation is generally shaped to conform to the recess.

27. The apparatus of claim 25, wherein the encapsulation generally complies with the expandable tubular as it is expanded against a formation.

28. The apparatus of claim 25, wherein the encapsulation comprises at least one arcuate wall.

29. The apparatus of claim 24, wherein the recess comprises at least one arcuate wall.

30. A method for controlling at least one downhole tool or instruments through an expandable sand screen from a surface of a wellbore, comprising;

providing the expandable sand screen in the wellbore, the expandable sand screen having a first inner diameter and comprising:

a base pipe layer, a filtering media layer around the base pipe layer, and an outer shroud around the filtering media layer, one or more of the following disposable within a recess formed in wall of the outer shroud: control lines, instrumentation lines, fiber optics, downhole sensors, data acquisition lines, and communication lines; and expanding the expandable sand screen to a second inner diameter, the second inner diameter larger than the first inner diameter, wherein the one or more of the control lines, instrumentation lines, fiber optics, and downhole sensors is protected during the expansion.

31. An expandable sand screen tool for use in a wellbore within a formation, the tool comprising:

a perforated base pipe layer, a filtering media layer around the base pipe layer;

a perforated outer shroud around the filtering media layer, and wherein a recess is formed in a wall of the outer shroud; and an encapsulation disposed within the recess; the recess serving as a housing for one or more of the following during expansion of the expandable tubular: control lines, instrumentation lines, fiber optics, and downhole sensors.

32. The expandable sand screen tool of claim 31, wherein the recess is formed in an outer surface of the wall.

33. An expandable sand screen, comprising:

a base pipe layer;

a filtering media layer around the base pipe layer; and an outer shroud around the filtering media layer, a wall of the outer shroud having a recess formed therein, the recess defining a housing for one or more of the following during expansion of the expandable sand screen: control lines, instrumentation lines, fiber optics, and downhole sensors, wherein a thickness of a wall of the expandable sand screen decreases upon expansion.

34. The expandable sand screen of claim 33, wherein the expandable sand screen is in an expanded state and the wall is in substantial contact with a wall of a wellbore.

35. The expandable sand screen of claim 33, wherein the expandable sand screen is in an expanded state and the wall is in substantial contact with casing disposed in a wellbore.

36. The expandable sand screen of claim 33, further comprising an encapsulation within the recess, the recess serving as a housing for one or more of the following: control lines, instrumentation lines, fiber optics, and downhole sensors, which reside within the encapsulation.

37. The expandable sand screen of claim 36, the encapsulation further comprising at least one arcuate wall.

38. The expandable sand screen of claim 33, wherein the recess comprises at least one arcuate wall.

39. A method for controlling at least one downhole tool or instrument through an expandable sand screen from a surface of a wellbore, comprising:

providing the expandable sand screen in the wellbore, the expandable sand screen comprising:

a base pipe layer, a filtering media layer around the base pipe layer, and an outer shroud around the filtering media layer, one or more of the following disposable within a recess formed in a wall of the outer shroud: control lines, instrumentation lines, fiber optics, downhole sensors, data acquisition lines, and communication lines; and expanding the expandable sand screen, thereby decreasing a thickness of a wall of the sand screen, wherein the one or more of the control lines, instrumentation lines, fiber optics, and downhole sensors is protected during the expansion.

40. The method of claim 39, wherein the one or more of the control lines, instrumentation lines, fiber optics, and downhole sensors moves radially outward while expanding the expandable sand screen.

41. The method of claim 39, wherein expanding the expandable sand screen comprises expanding from an inner diameter of the expandable sand screen.

* * * * *